US012152850B2

(12) United States Patent
Ståhl

(10) Patent No.: US 12,152,850 B2
(45) Date of Patent: Nov. 26, 2024

(54) GRENADE LAUNCHER

(71) Applicant: Berserk Sweden AB, Hjärup (SE)

(72) Inventor: Ivan Henrik Ståhl, Hjärup (SE)

(73) Assignee: Berserk Sweden AB, Hjärup (SE)

( * ) Notice: Subject to any disclaimer, the term of this patent is extended or adjusted under 35 U.S.C. 154(b) by 0 days.

(21) Appl. No.: 18/060,822

(22) Filed: Dec. 1, 2022

(65) Prior Publication Data

US 2023/0175801 A1 Jun. 8, 2023

(30) Foreign Application Priority Data

Dec. 2, 2021 (SE) ..... 2151474-0

(51) Int. Cl.
*F41A 19/52* (2006.01)
*F41A 17/74* (2006.01)
*F41A 19/18* (2006.01)

(52) U.S. Cl.
CPC ..... *F41A 19/52* (2013.01); *F41A 17/74* (2013.01); *F41A 19/18* (2013.01)

(58) Field of Classification Search
CPC ..... F41A 17/74; F41A 19/14; F41A 19/18; F41A 19/52; F41A 21/484; F42B 5/02; F42C 19/0823; F42C 19/10; F41F 1/08; F41G 11/003
See application file for complete search history.

(56) References Cited

U.S. PATENT DOCUMENTS 3,482,348 A 12/1969 Zanchi
3,507,067 A * 4/1970 Into ..... F41C 27/06 89/14.05
3,641,691 A * 2/1972 Ellis ..... F41C 27/06 42/105
3,643,545 A 2/1972 Nahas
5,560,132 A 10/1996 Merlino
5,590,484 A * 1/1997 Mooney ..... F41G 1/16 42/111
5,628,137 A 5/1997 Cortese
6,481,145 B2 * 11/2002 Weichert ..... F41C 27/06 42/105
6,839,998 B1 1/2005 Armstrong
11,187,474 B2 * 11/2021 Masters ..... F41A 3/66
2005/0132628 A1 6/2005 Olson
2006/0191183 A1 8/2006 Griffin
2011/0167703 A1 7/2011 Deros
2014/0190061 A1 7/2014 Griffin
2016/0153744 A1 6/2016 Teetzel et al.
2019/0011219 A1 * 1/2019 Mezynski ..... F41C 27/06
2019/0162505 A1 * 5/2019 Mezynski ..... F41C 27/00

FOREIGN PATENT DOCUMENTS

FR 2253200 6/1975
GB 310084 4/1929
KR 20170014876 A 2/2017
PH 12015000192 A1 * 12/2016 ..... F41C 27/00
RU 2669977 C2 10/2018

* cited by examiner

*Primary Examiner* — Bret Hayes

(74) *Attorney, Agent, or Firm* — Capitol City TechLaw

(57) ABSTRACT

A grenade launcher may include at least one barrel for receiving a grenade, a support for releasably mounting the grenade launcher to a carrier, and a receiving slot receiving a removable primer cartridge. The primer cartridge when received in the receiving slot may hold a primer in position for firing the grenade in the barrel.

19 Claims, 12 Drawing Sheets

GRENADE LAUNCHER

This application claims priority under 35 USC 119(a)-(d) from Swedish Application No. 2151474-0 filed on Dec. 2, 2021, the entire contents of which are incorporated herein by reference.

BACKGROUND

1. Technical Field

The present invention relates to a tube launcher. More particularly, the invention concerns a tube launcher such as a grenade launcher that can be mounted under the barrel of a conventional gun.

2. Discussion of Related Art

In a general manner, a grenade launcher is already known which is mounted in a permanent or detachable manner under the barrel of a gun and which is provided with its own trigger so as to be able to fire grenades, whereby said trigger is situated in front of said chamber.

Certain grenade launchers are provided with their own grip, which enables a shooter to hold the gun with his strong hand at the grip of the gun and with his weak hand at a grip of the grenade launcher, thus forcing him to use his weak hand to operate a trigger of the grenade launcher. Many prior art grenade launchers are dimensioned for comparatively power full grenade with a diameter of at least 35-40 mm. Such launchers may reach up to and ever beyond 300 m and may cause physical injuries on persons at far distances.

From the above it is understood that there is room for improvements and the invention aims to solve or at least mitigate the above and other problems.

SUMMARY

The invention is defined by the appended independent claims. Additional features and advantages of the concepts disclosed herein are set forth in the description which follows, and in part will be obvious from the description, or may be learned by practice of the described technologies. The features and advantages of the concepts may be realized and obtained by means of the instruments and combinations particularly pointed out in the appended claims. These and other features of the described technologies will become more fully apparent from the following description and appended claims or may be learned by the practice of the disclosed concepts as set forth herein.

The disclosed tube launcher or grenade launcher is configured to receive at least one grenade that can be launched or fired by igniting a primer of a primer cartridge. The grenade launcher comprises a support that can be attached or connected to and released from a carrier device, such as a gun.

In a first aspect there is disclosed a grenade launcher comprising at least one barrel for receiving a grenade, a support for releasably mounting the grenade launcher to a carrier, and a receiving slot receiving a removable primer cartridge; wherein the primer cartridge when received in the receiving slot holds a primer in position for firing the grenade in the barrel.

The grenade launcher can be launched by a firing mechanism, such as by manually cocking a spring biased cock followed by releasing the spring biased cock to hit the primer.

BRIEF DESCRIPTION OF THE DRAWINGS

In order to best describe the manner in which the above-described embodiments are implemented, as well as define other advantages and features of the disclosure, a more particular description is provided below and is illustrated in the appended drawings. Understanding that these drawings depict only exemplary embodiments of the invention and are not therefore to be considered to be limiting in scope, the examples will be described and explained with additional specificity and detail through the use of the accompanying drawings in which.

Further, in the figures like reference characters designate like or corresponding parts throughout the several figures.

DETAILED DESCRIPTION

Various embodiments of the disclosed methods and arrangements are discussed in detail below. While specific implementations are discussed, it should be understood that this is done for illustration purposes only. A person skilled in the relevant art will recognize that other components, configurations, and steps may be used without parting from the spirit and scope of the disclosure.

In the description and claims the word "comprise" and variations of the word, such as "comprising" and "comprises", does not exclude other elements or steps.

Hereinafter, certain embodiments will be described more fully with reference to the accompanying drawings. It will be apparent to those skilled in the art that various modifications and variations can be made without departing from the inventive concept. Other embodiments will be apparent to those skilled in the art from consideration of the specification and practice disclosed herein. The embodiments herein are provided by way of example so that this disclosure will be thorough and complete and will fully convey the scope of the inventive concept, and that the claims be construed as encompassing all equivalents of the present inventive concept which are apparent to those skilled in the art to which the inventive concept pertains. If nothing else is stated, different embodiments may be combined with each other.

The word grenade will be used for different types of bullets, shells, stun bombs, flash grenade, flashbangs, thunder flashes, sound bombs and similar devices comprising some kind of pyrotechnical composition and an effect composition. It will normally have a delay after being ignited to allow it to be launched or thrown some distance where the effect composition will be activated or ignited after the delay. Normally, the grenade in this context is less-lethal.

The grenade launcher according to embodiments may be a grenade launcher for close quarter combat or other short-range firing of grenades or the like. The grenade launcher may be a grenade launcher for indoor launching of grenades. In particular, the grenade launcher may be used with low impact grenades.

Figure 1:
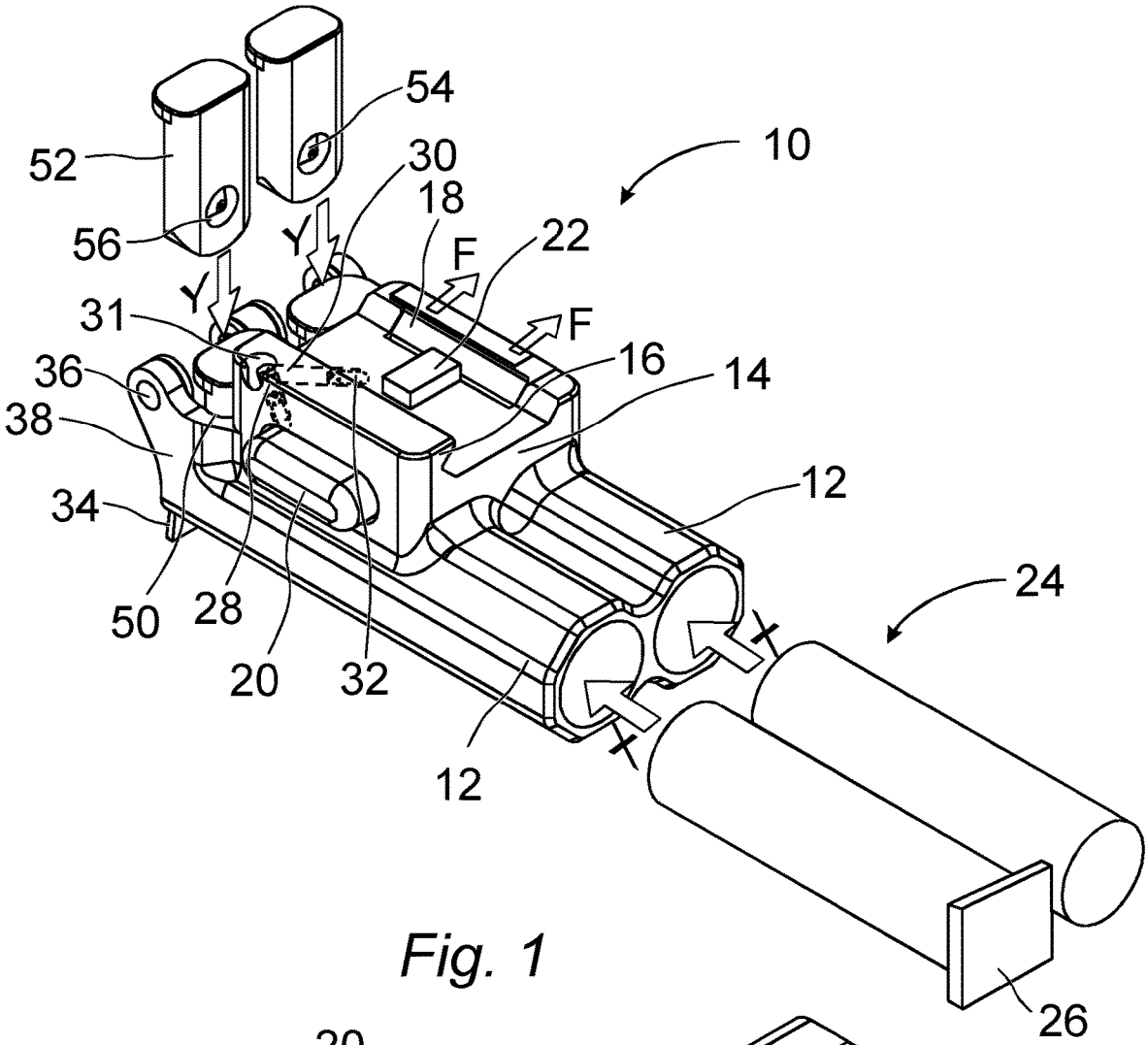
FIG. 1 is a schematic perspective view of a disclosed grenade launcher with cartridges and shells with pyrotechnics.
Figure 2:
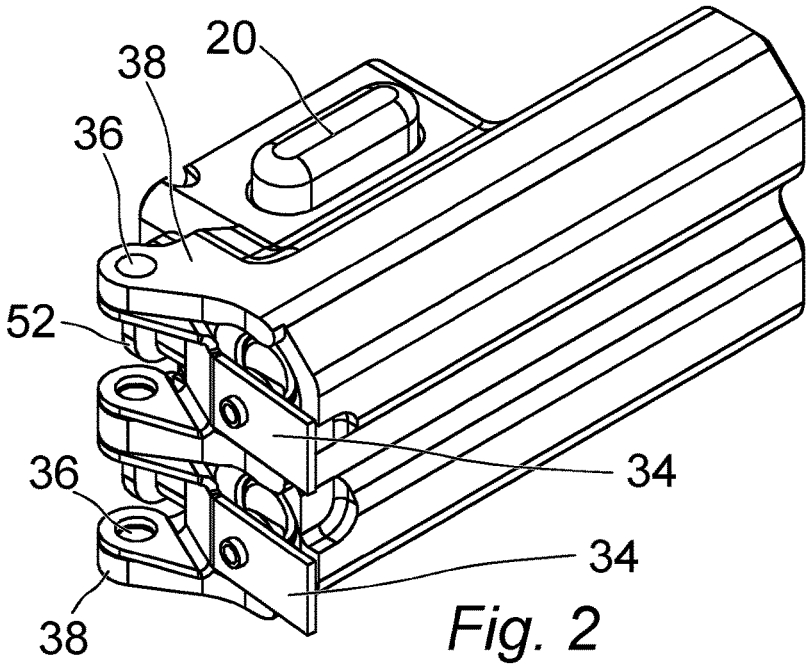
FIG. 2 is a schematic perspective view of the grenade launcher of FIG. 1 showing a firing mechanism.
Figure 3:
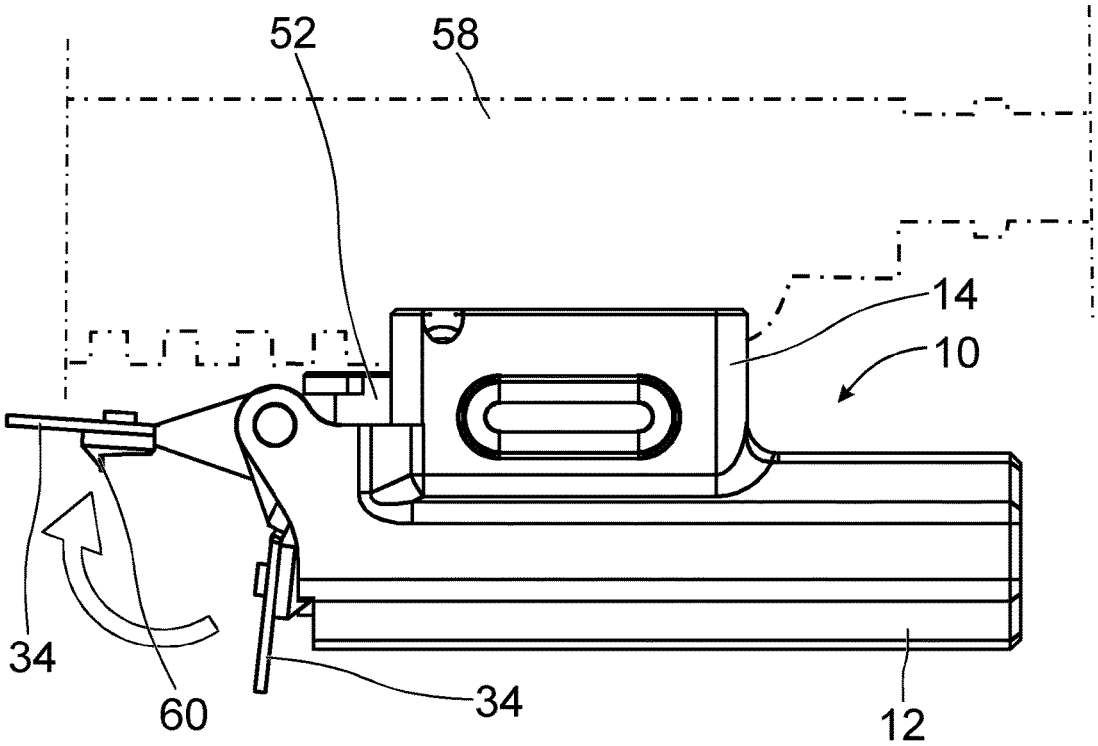
FIG. 3 is a schematic side elevation view of the grenade launcher of FIG. 1 showing the firing mechanism in an armed position.

The embodiment shown in FIG. 1 to FIG. 6 comprises a grenade launcher 10 with two barrels 12 and a support 14 designed for attachment to a guide rail, such as a Picatinny rail, on a gun or another type of carrier, such as a helmet or vehicle. In the shown embodiment, the support 14 comprises a first fixed clamp portion 16 and a second sliding clamp portion 18. The clamp portions 16, 18 are designed to engage a dovetail section on the guide rail. In the embodiment shown in FIG. 1, the sliding clamp portion 18 can be slid in the direction of arrows F by pressing a spring biased knob 20. By pressing the spring biased knob 20 it is possible to slide the support 14 over a guide rail mounted for instance under the barrel of the gun, c.f. FIG. 3. The support 14 and consequently the complete grenade launcher 10 will be locked in position when the spring biased knob 20 is released. The grenade launcher 10 will be locked against movements in the longitudinal direction of the barrel by a boss 22 that will fit in a notch of the guide rail.

The barrels 12 are formed with an inner diameter which is matched to an outer diameter of a grenade 24. When a grenade 24 will be used it is slid into the barrel 12 in the direction of arrow X. In various embodiments, the grenade 24 is provided with a weather seal 26 that will engage the barrel 12 when the grenade is inserted in a front side of the barrel and keep the grenade dry.

In some embodiments, the support 14 is provided with a first bore 28 and a second bore 30 extending from a mounting recess 31 to an inside of each barrel. The bores 28, 30 have a threaded portion and in each bore a screw 32 is screwed down to a position where each screw extends into a barrel 12. The screws 32 will keep the grenades 24 in position when they have been inserted into the barrels 12. In alternative embodiments, a steel wire is provided along the barrels 12 and extending into in interior of the barrels 12 to lock grenades 24 disposed therein.

Figure 7:
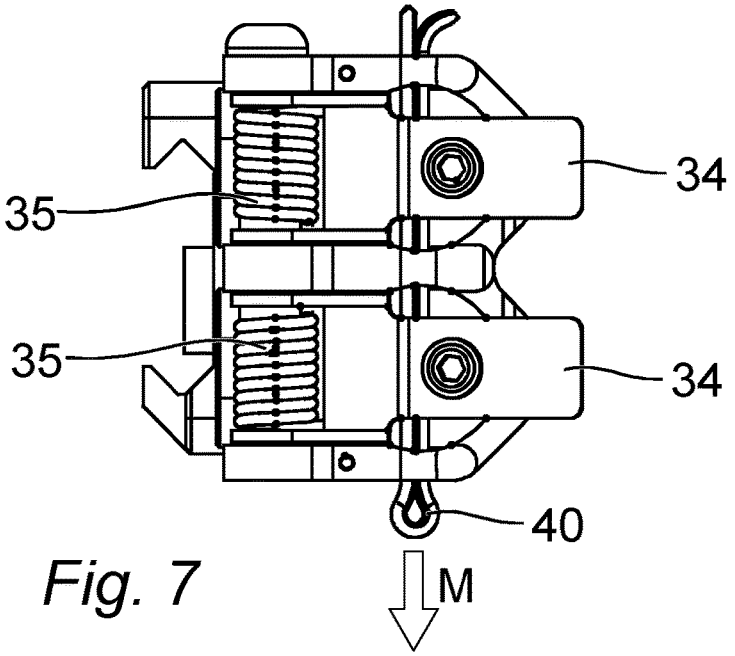
FIG. 7 is a is a schematic rear view the grenade launcher of FIG. 5 including also a locking pin and springs for biasing cocks of the grenade launcher.
Figure 8:
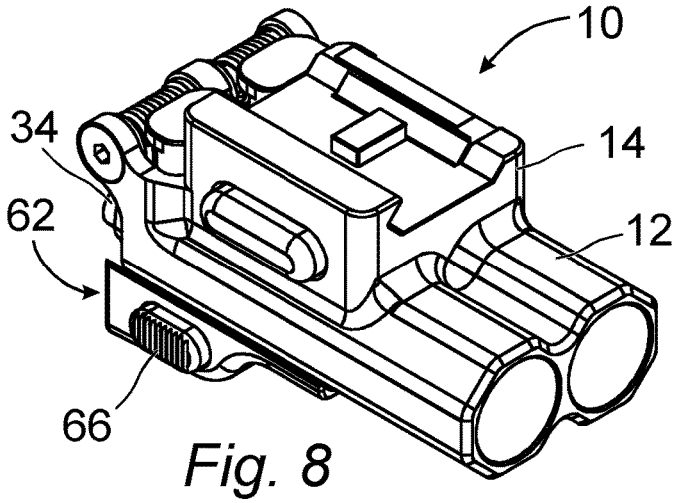
FIG. 8 is schematic perspective view of a second embodiment of an empty grenade launcher with an alternative safety arrangement put at safety.

A spring biased cock 34 is arranged at rear side of the barrels 12. The cock 34 rotates around shafts or pins 36 that are mounted in fastening wings 38 extending from a rear section of the support 14. The function of the cock 34 will be explained further on below. Springs 35 for biasing the cocks 34 are shown in FIG. 7.

At the rear side of each barrel 12 there is provided a slot 50 designed to receive a primer cartridge 52. Each primer cartridge 52 can hold one primer 54 in a primer pocket 56. The primer 54 normally contains a charge such as a small amount of gun powder. When hit by the cock 34 it will provide a primer flame that ignites a pyrotechnical composition of a delay train of the grenade 24. When the primer cartridge 52 is fully inserted into the slot 50 the primer 54 will be located in front of the barrel 12, normally at a central position. It should be noted that two primer supports 52 already are in position in the slots 50. The primer cartridge 52 is moved into position in the slot 50 in a direction indicated by arrow Y.

In various embodiments, the primer 54 is replaceable in the primer cartridge 52. When the primer 54 has been fired, it can be replaced by a new primer. In other embodiments, the primer cartridge 52 is integral with the primer 54. In such embodiments, the primer cartridge 52 including the primer 54 is exchanged after firing the primer 54.

Figure 4:
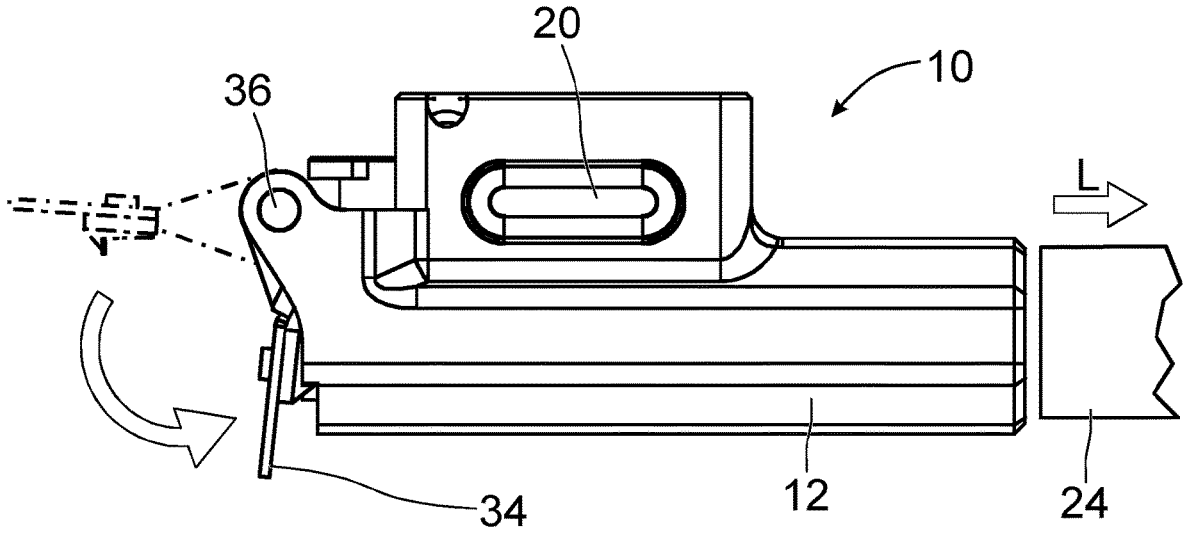
FIG. 4 is a schematic side elevation view of the grenade launcher of FIG. 3 showing the firing mechanism with a released cock.

In FIG. 3 a grenade launcher 10 is shown armed, with the cock 34 rotated into an armed upper position. The cock 34 is spring biased to a lower position as shown in FIG. 4. The rotation of the cock 34 can be made by the person handling the grenade launcher with a finger (no finger shown in the drawings). The person handling the grenade launcher maintains the cock 34 in this position until either firing of the grenade launcher or re-positioning the cock 34 to the lower non-armed position is decided. By releasing the cock 34 it will rotate back to a lower position as shown in FIG. 4, and a firing pin 60 impacts the primer 54. This will ignite a pyrotechnical composition of a delay train of the grenade 24 immediately, and the grenade 24 is fired and launched from the barrel 12 in the direction of arrow L as indicated in FIG. 4. The delay train burns and ignites an effect composition of the grenade after a predefined delay time. A gun 58 supporting the grenade launcher 10 indicated by dash-and-dot lines in FIG. 3.

In various embodiments, the delay train will provide a delay time of at least one second and not longer than five seconds. Different types of pyrotechnical compositions can be used for providing the intended delay time.

Figure 5:
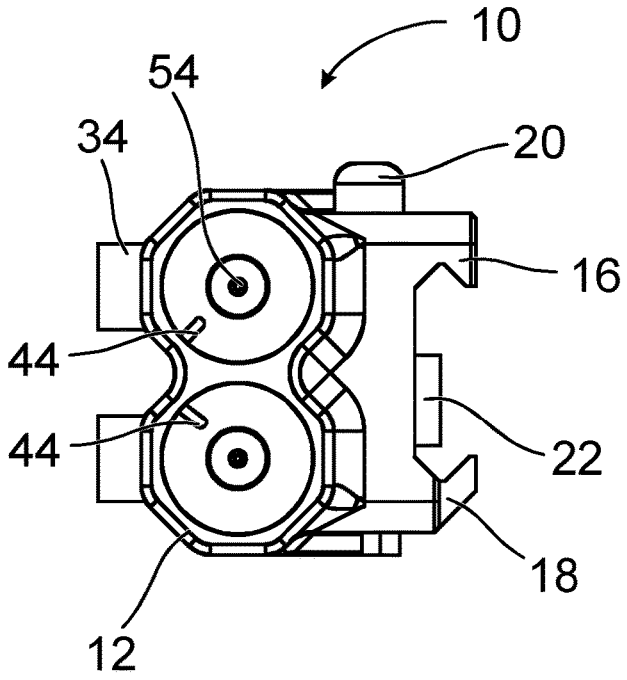
FIG. 5 is a schematic front view the grenade launcher of FIG. 1 showing two empty barrels.
Figure 6:
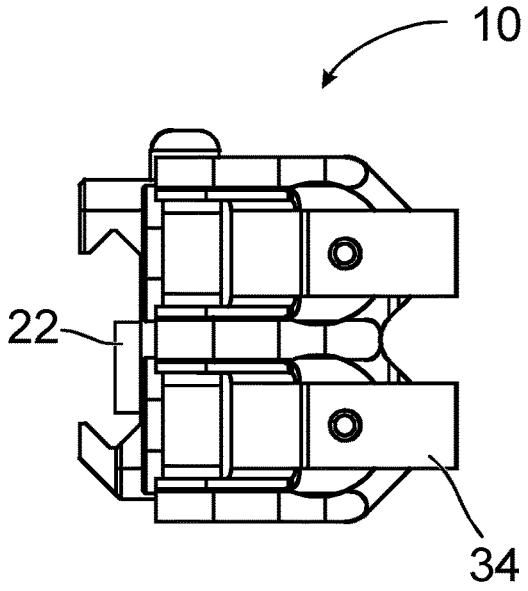
FIG. 6 is a schematic rear view the grenade launcher of FIG. 5.

The effect composition can comprise or combine different effects, such as one or a plurality of bangs, flashbangs, smoke, colored smoke, training shells without a bang or a low-level bang, The embodiment shown in FIG. 5 and FIG. 6 has two barrels 12. The barrels are shown empty and in FIG. 5 the primer 54 is shown to be centered in the barrel 12. A steel wire 44, such as piano wire, extends at a lower section inside and along each barrel 12. The steel wire 44 will lock the grenade when inserted into the barrel 12.

A safety arrangement is provided for preventing unintentional firing of the grenade launcher. One embodiment of the safety arrangement is shown in FIG. 7 and comprises a locking pin 40 arranged at a rear side of the barrels 12 between the primer cartridge 52 and the cocks 34. In this position, the locking pin 40 will prevent the cocks 34 from hitting the primers 54. When the grenade launcher 10 is intended to be used, the locking pin 40 is pulled out from the position shown in FIG. 7 in the direction of arrow M.

An alternative embodiment of a safety arrangement is shown in FIG. 8 to FIG. 14. This safety arrangement comprises a sliding carriage 62 mounted below the barrels 12. When the safety arrangement is put at safety, as shown in FIG. 8 to FIG. 11, the sliding carriage 62 is locked in a rear position where the firing pins 60 of cocks 34 are prevented from reaching or impacting any of the primers 54 (not shown in this figure). In this position, the cocks 34 with the firing pins 54 will be engaging a rear side of the sliding carriage 62.

Figure 9:
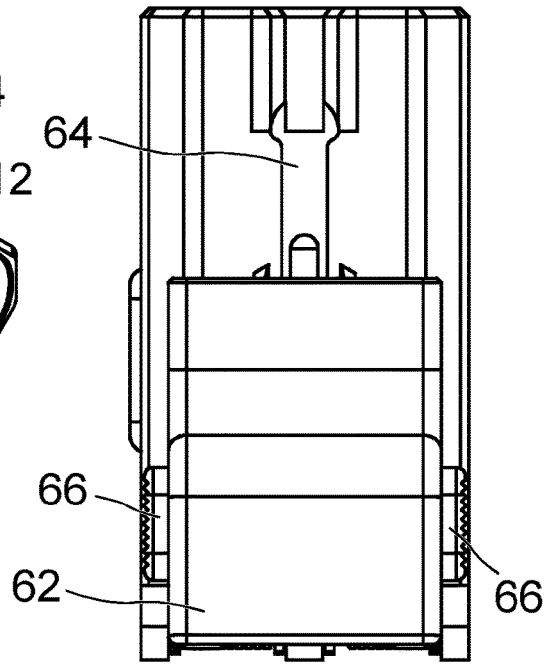
FIG. 9 is schematic bottom view of the grenade launcher shown in FIG. 8.
Figure 10:
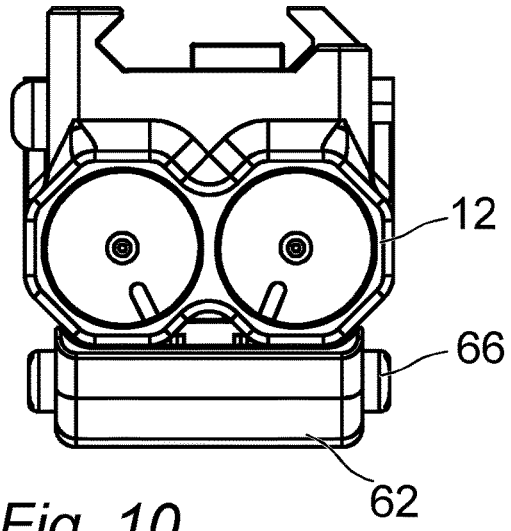
FIG. 10 is schematic front view of the grenade launcher shown in FIG. 8.
Figure 11:
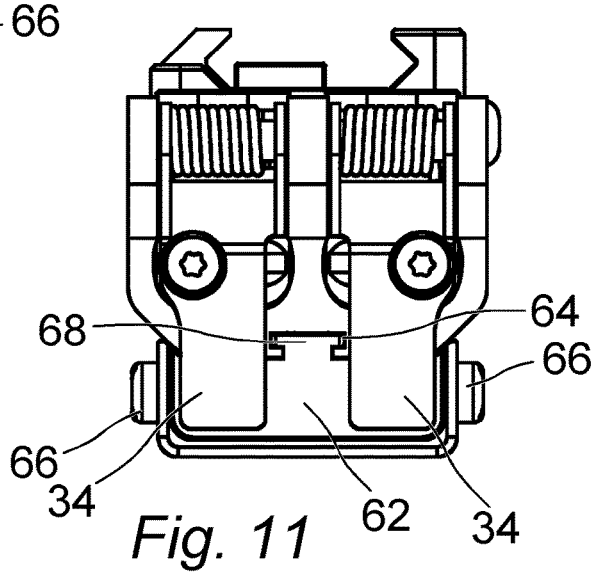
FIG. 11 is schematic rear view of the grenade launcher shown in FIG. 8.
Figure 12:
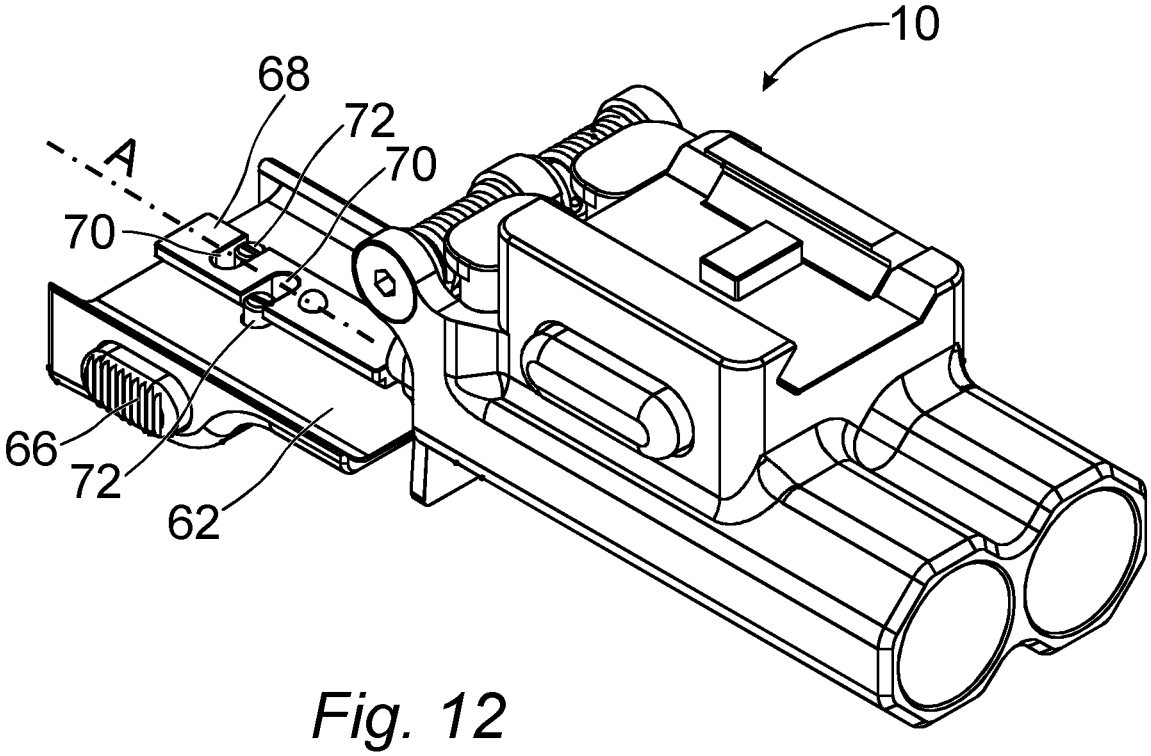
FIG. 12 is schematic perspective view of the grenade launcher shown in FIG. 8 before mounting of the safety arrangement.

The bottom view in FIG. 9 shows a groove 64 provided at an underside of the support 14 of the grenade launcher. The sliding carriage 62 is inserted into the groove 64 from behind as shown in FIG. 12 and can slide in a forward direction to an unlocked position. As shown in FIG. 9, the groove 64 ends before a rear end section of the grenade launcher. The sliding carriage 62 is provided with two spring biased release buttons 66 arranged opposite each other. Both release buttons 66 need to be depressed for moving the sliding carriage forward to the unlocked position. In some embodiments, only one release button is provided. The sliding carriage 62 comprises an elongated slide 68 that is configured to slide in the groove 64. In various embodiments, the slide 68 is T-shaped.

In FIG. 12, the sliding carriage 62 is shown before being mounted to the grenade launcher. Two longitudinally spaced apart locking recesses 70 are formed in transverse directions in longitudinal side sections of the T-shaped slide 68. The spring biased release buttons 66 extend from side sections to a central position of the sliding carriage 62 and are each provided with an upright locking peg 72 at an inner end. As shown in FIG. 12, each upright locking peg 72 fits in one locking recess 70 and is spring biased to the position shown in FIG. 12. Each of the locking pegs 72 is connected to one release button 66 and can be slid towards a central line A of the T-shaped slide 68 by depressing the associated release button 66. In this position, the locking pegs 72 will be received in the locking recesses 70 and will not extend out from the longitudinal side sections of the T-shaped slide 68. In embodiments where only one release button is used there is provided only on locking peg 72.

Figure 13:
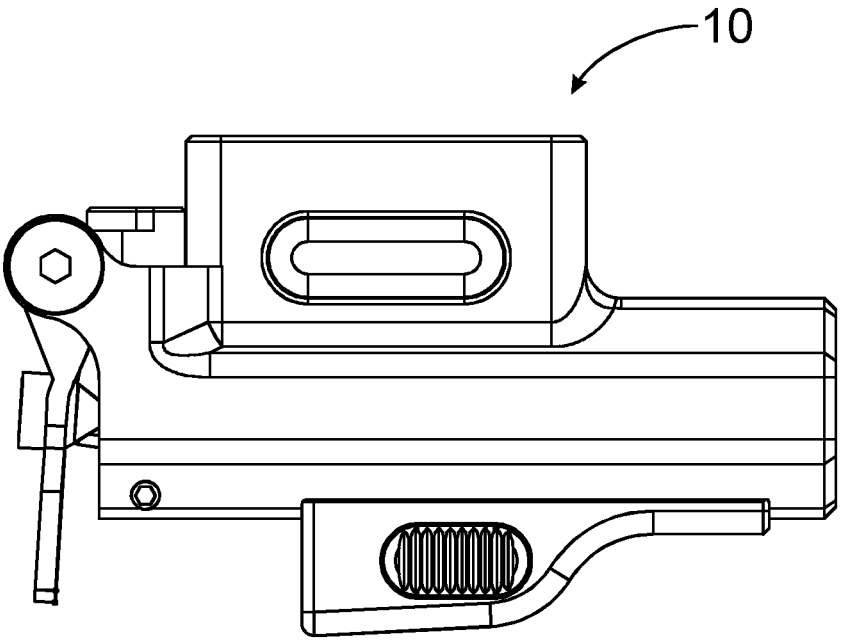
FIG. 13 is schematic side view of the grenade launcher shown in FIG. 8 with the safety arrangement in an unlocked position.

When the sliding carriage 62 is to be mounted in the grenade launcher, both release buttons 66 are depressed to move the locking pegs 72 into the locking recesses 70 to allow sliding of the T-shaped slide into the groove 64. It is necessary also to rotate the cocks 34 from the position shown in FIG. 12. FIG. 13 shows the sliding carriage 62 fully mounted and set into the unlocked position.

Figure 14:
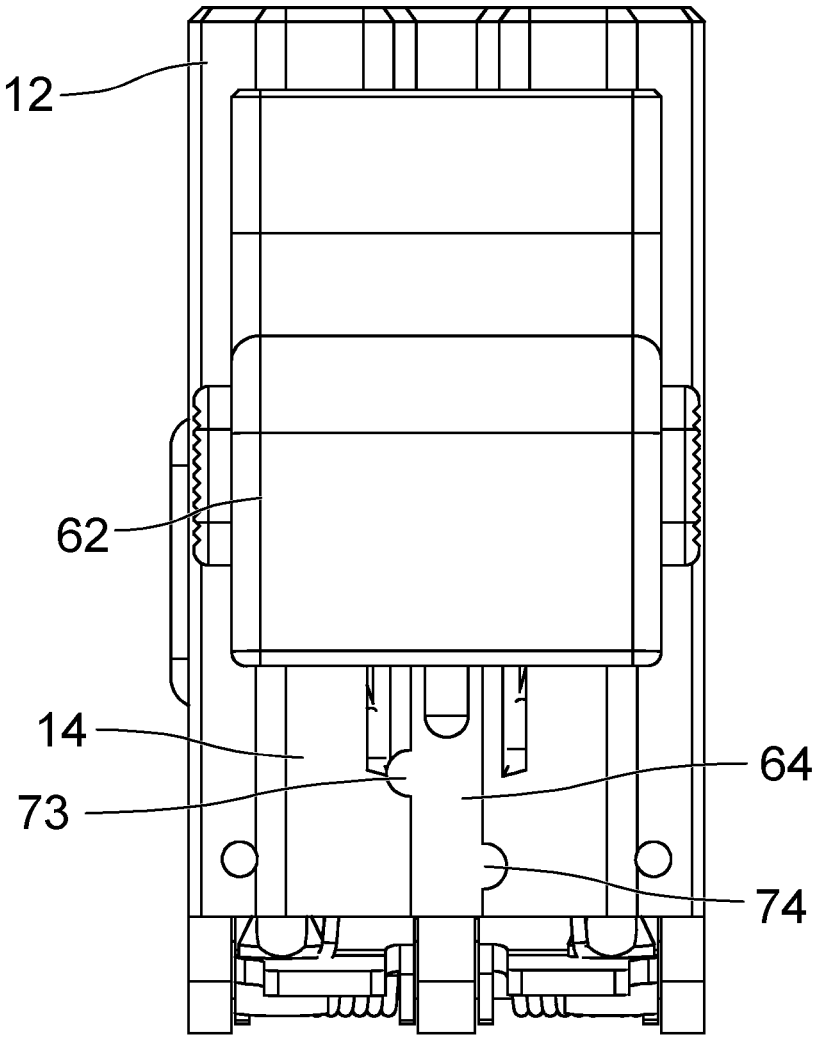
FIG. 14 is a schematic bottom view of the grenade launcher shown in FIG. 8 with the safety arrangement in an unlocked position.

FIG. 14 shows a bottom view of the grenade launcher 10 with the sliding carriage 62 fully mounted and set into the unlocked position. A rear section of the groove 64 is open at a rear side of the support 14. A first indentation 73 and a second indentation 74 are provided in the rear section of the groove 64 at longitudinally spaced apart positions. The indentations 73, 74 are each configured to receive one of the locking pegs 72 when the sliding carriage 62 is locked in a rear position and the safety arrangement is put at safety. The safety arrangement is set to the unlocked position by depressing the release buttons 66 to displace the locking pegs 72 from the indentations 73, 74 and then sliding the sliding carriage forward on the support 14.

Figure 15A:
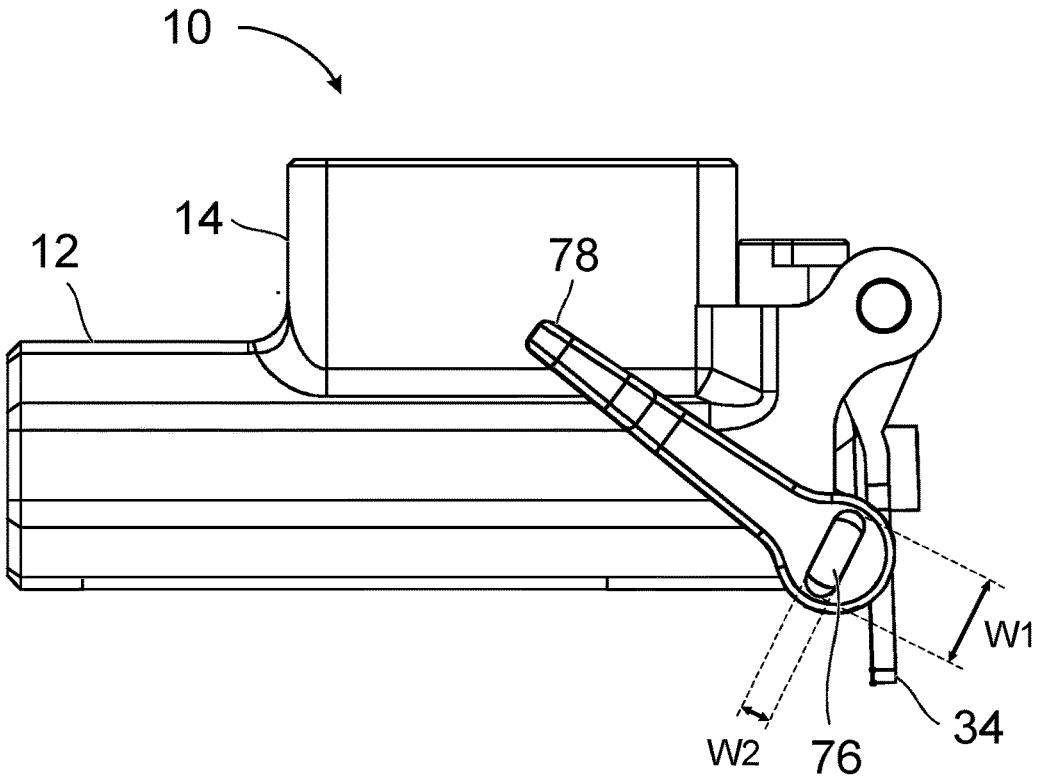
FIGS. 15A-D are schematic views of a safety arrangement according to embodiments.
Figure 15B:
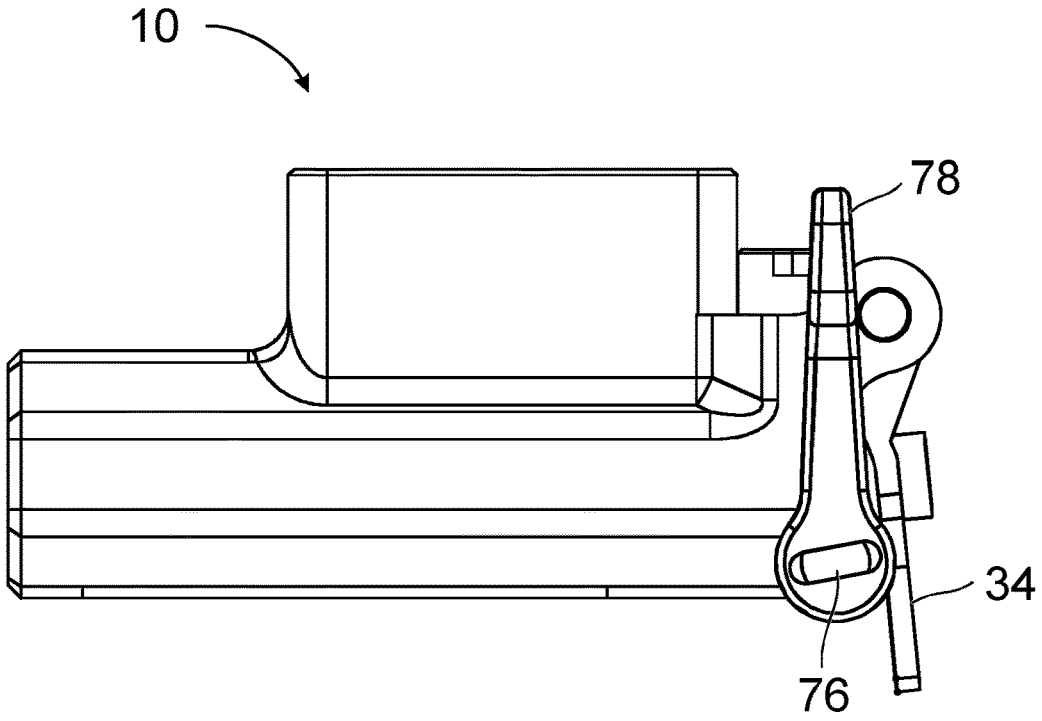
Figure 15C:
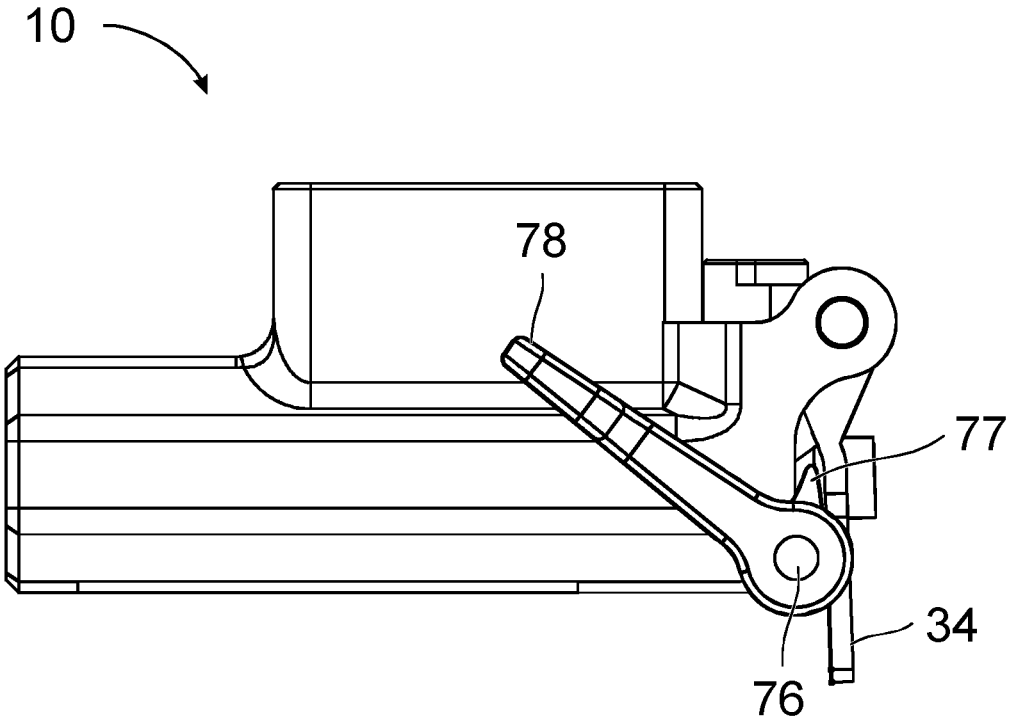
Figure 15D:
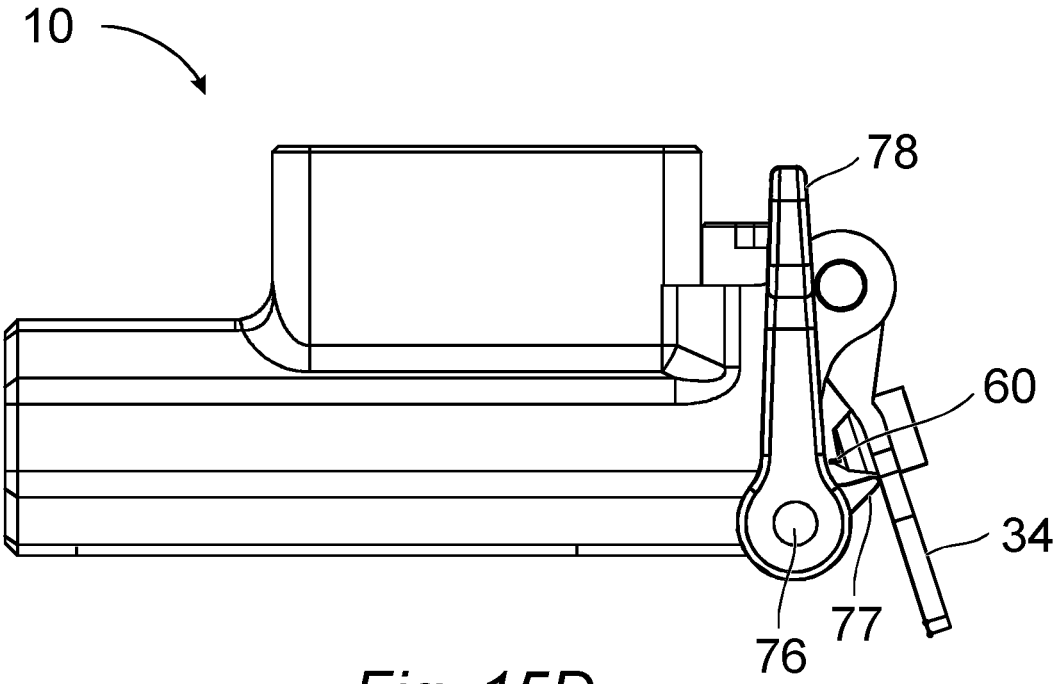

FIGS. 15A-D show yet another alternative safety arrangement. FIGS. 15A and 15C show the safety arrangement in an unlocked position, and FIGS. 15B and 15D show the safety arrangement in a locked position.

The safety arrangement comprises a rod 76. The rod 76 may be arranged at a rear side of the barrels 12 between the primer cartridge 52 and the cocks 34. The rod 76 may extend behind one or more of the barrels 12 of the grenade launcher 10.

The rod 76 is rotatably arranged such that the rod 76 can be rotated around a longitudinal axis of the rod 76. The axis of rotation may also be referred to as a rotational axis. The longitudinal axis may be any axis extending along the length of the rod 76. For example, the longitudinal axis may be a central longitudinal axis extending along the centre of the rod 76.

As shown in FIGS. 15A and 15B, the rod 76 may be a substantially flat rod. The flat rod may have a width W1 in a first direction and a width W2 in a second direction. The width W1 may be larger than the width W2, or vice versa.

In the locked position as shown in FIG. 15B, the rod 76 is rotated to a first rotational position. In the first rotational position, the rod 76 extends towards the cock 34 (and/or the path of the cock 34) along its width W1. The width W1 is sufficiently large to cause the rod 76 to intersect with the path of the cock 34 as the cock 34 moves towards the primer 54 (not shown). Thus, the rod 76 prevents the cock 34, and in particular the firing pins 60, from reaching and/or impacting said primers 54. Hence the safety arrangement is at a "safe" position.

In the unlocked position, as shown in FIG. 15A, on the other hand, the rod 76 is rotated to a second rotational position. In the second rotational position, the rod 76 is rotated such that it extends towards the cock 34 along the width W2. Because the width W2 is smaller than the width W1, the rod 76, in the second rotational position, may not intersect with the path of the cock 34. Thus, the cock 34 can move freely towards the primer 54, and hence the firing pin 60 can impact said primer 54 causing a grenade to be launched.

It will be appreciated that although a flat rectangular rod is shown in FIGS. 15A and 15B, embodiments are not limited to such a rod shape. Embodiments include any rod shape that can be rotated to cause intersection with the cock path in a first rotational position, and to cause no intersection with the cock path in a second rotational position.

The rod 76 may for example be a substantially symmetrical rod provided with a protrusion 77 at an angular portion thereof as seen in FIGS. 15C and 15D. The protrusion 77 may be provided along the entire length of the rod 76, or along portions of the rod 76 corresponding to the locations of the cock(s) 34. For example, there may be provided no protrusions 77 at longitudinal positions of the rod 76 corresponding to the firing pins 60, such that the rod 76 only interacts with the cock 34 and not the firing pin 60. When the rod 76 is rotated to the locked position as shown in FIG. 15D, the protrusion 77 may protrude towards the cock 34 so as to intersect with the path of the cock 34 preventing the cock 34 from reaching the primer 54. When the rod 76 is rotated to the unlocked position as shown in FIG. 15C, the protrusion 77 may protrude at least partially away from the cock 34 so as to allow the cock 34 (and/or firing pin 60) to reach the primer 54.

The safety arrangement may further comprise a handle 78 allowing a user to rotate the rod 76 between the first and second rotational positions. For example, the handle 78 may be pivoted around the rotational axis of the rod 76. The handle 78 may be provided on an outer side of the grenade launcher 10 to allow a user to easily access the handle 78.

FIGS. 16A to 18B show a grenade launcher 80 with modular barrels 81. The grenade launcher 80 with modular barrels 81 may also be referred to as a modular barrel grenade launcher. The modular barrels 81 may be removed from the grenade launcher 80 and interchangeably inserted into the grenade launcher 80. Thus, a user may choose their desired barrels 81, and/or their desired order of barrels 81, when loading and/or mounting the grenade launcher 80.

Each modular barrel 81 comprises on a first side one or more male connectors 83 (e.g. studs), and on a second side opposite to the first side one or more female connectors 84 (e.g. holes) in corresponding positions. Thus, a plurality of modular barrels 81 may be connected, and secured, in sequence.

Figure 16A:
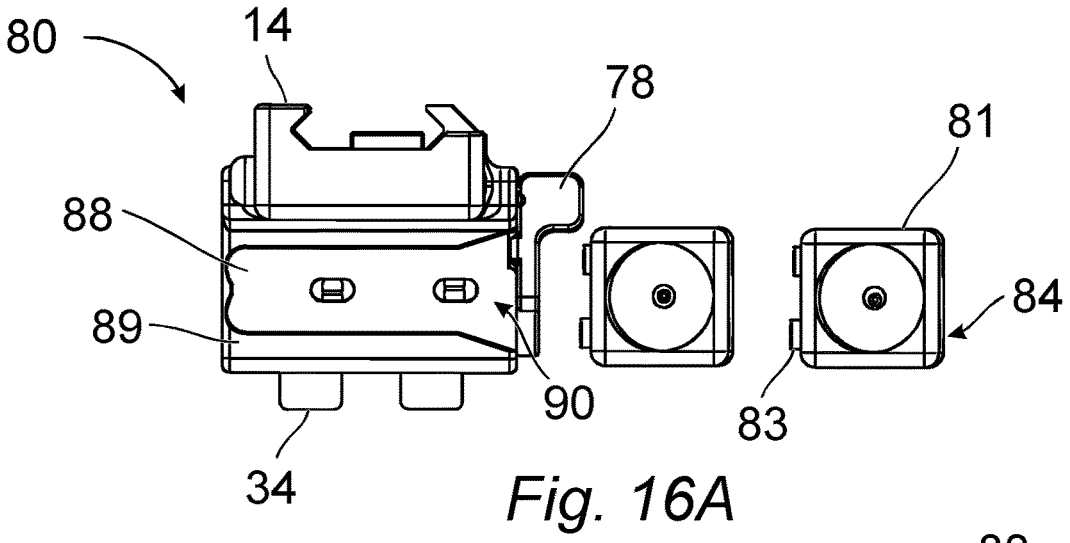
FIGS. 16A-C are schematic views of an unassembled grenade launcher with modular barrels according to embodiments.
Figure 16B:
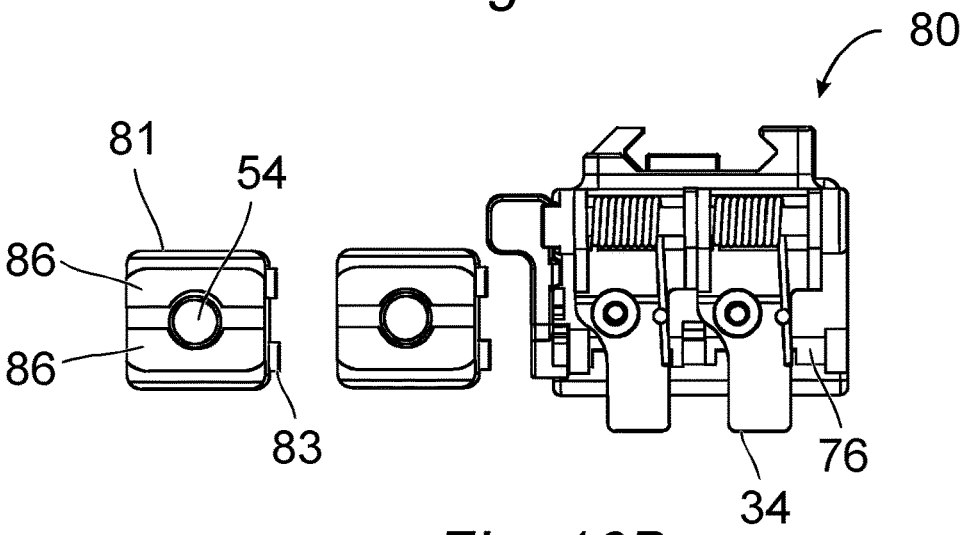
Figure 16C:
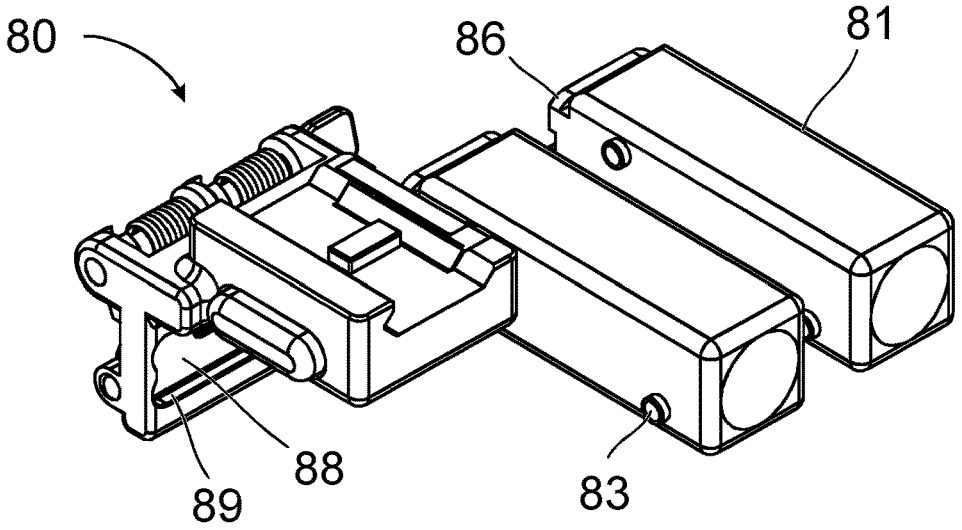
Figure 17A:
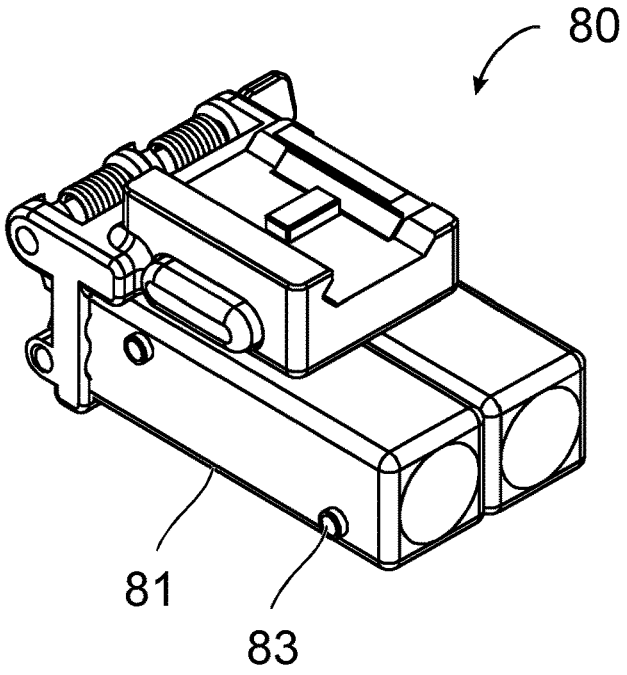
FIGS. 17A-B are schematic views of an assembled grenade launcher with modular barrels according to embodiments.
Figure 17B:
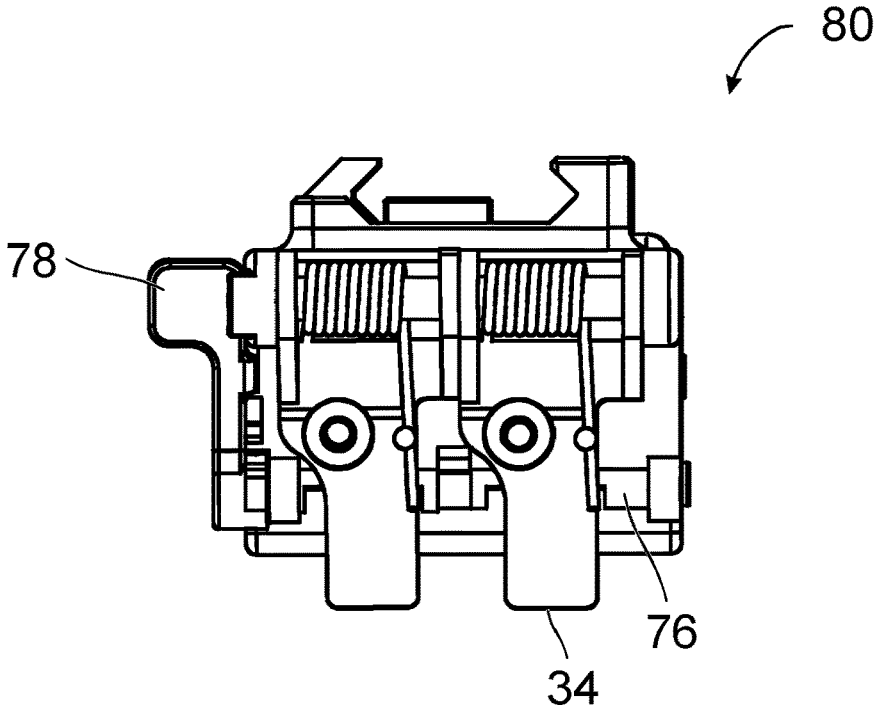
Figure 18A:
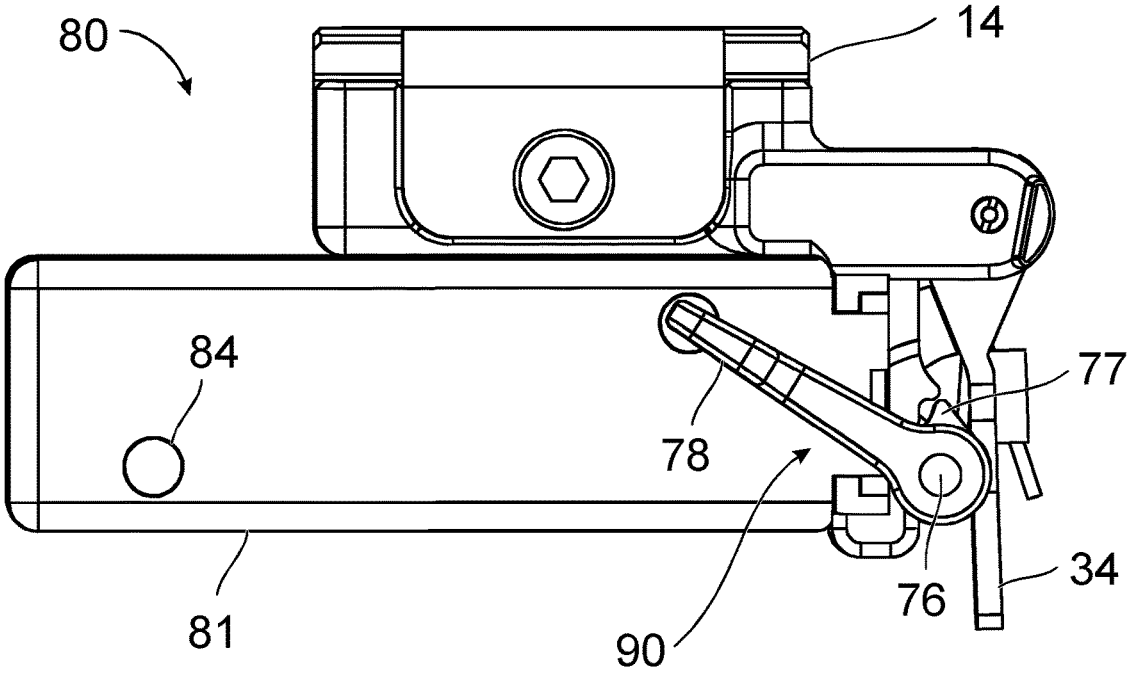
FIGS. 18A-B are schematic views of a safety arrangement according to embodiments.
Figure 18B:
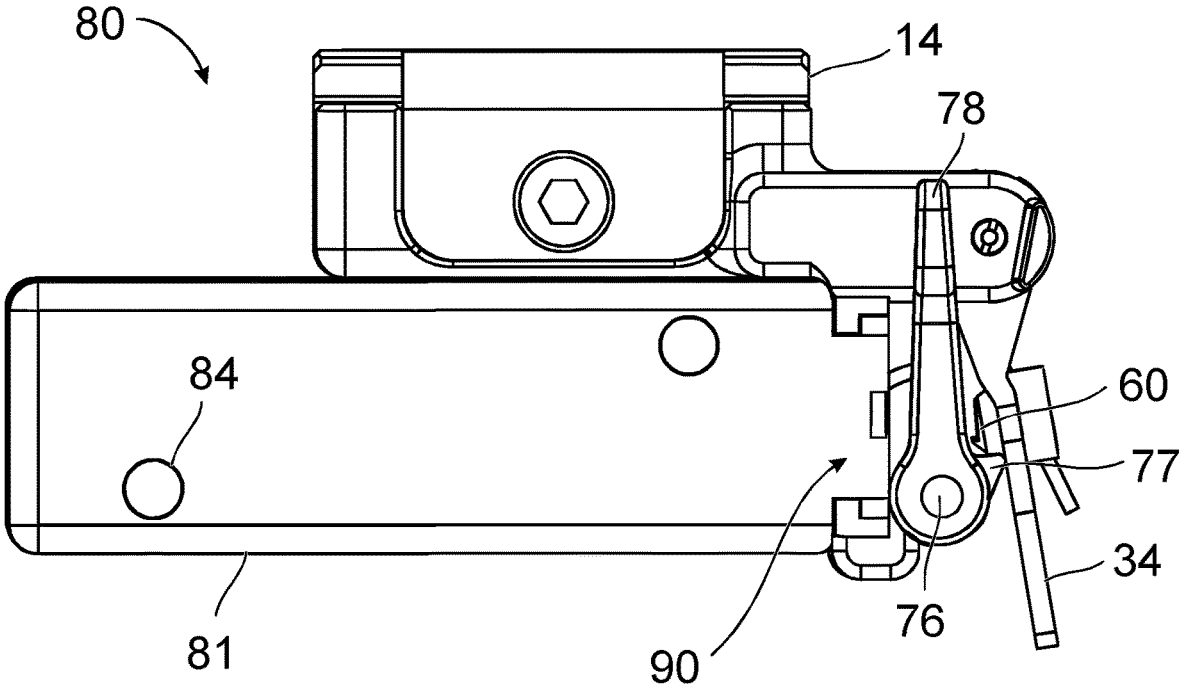

The barrels 81 are shown empty and in FIG. 16B the primer 54 is shown to be centered in each barrel 81. Each barrel 81 comprises a first end side and a second end side. The primer 54 is located at the first end side, and the second end is configured to receive the grenade 24.

The barrels 81 also comprise engaging flanges 86 for engagement with the grenade launcher 80. The engaging flanges 86 are preferably located at or on the same end side of the modular barrel 81 as the primer 54, i.e. at the first end side. The engaging flanges 86 preferably comprise two or more parallel flanges. A first and second flanges may preferably extend in a direction perpendicular to the first and second sides. For example, a first flange may be provided at an upper portion of the first end side, and a second flange may be provided at a lower portion of the first end side.

The grenade launcher 80 comprises a barrel slot 88 for receiving one or more modular barrels 81. The barrel slot 88 may be arranged to accommodate one, two, three or more modular barrels 81. The barrel slot 88 comprises a slide rail 89 arranged to engage with the engaging flanges 86 of the modular barrels 81 such that the modular barrels 81 can be slid into, and along, the barrel slot 88.

The barrel slot 88 preferably comprises an inlet 90 for receiving the modular barrels 81. When inserting the modular barrels 81, the modular barrels 81 may be inserted into the barrel slot 88 at the inlet 90, made to engage with the slide rail 89, and slid into position in the barrel slot 88. Preferably a plurality of modular barrels 81 may be inserted at the same time. That is, a plurality of modular barrels 81 may be connected in sequence away from the grenade launcher 80, and then the connected plurality of modular barrels 81 may be slid into the barrel slot 88 with one smooth sliding motion.

The modular barrel grenade launcher 80 also comprises one or more triggering mechanisms (one triggering mechanism for each modular barrel) for triggering the primers located in each barrel. The triggering mechanism shown in FIGS. 16A to 18B in relation to the modular barrel grenade launcher 80 is substantially the same as the previously described spring-loaded cock 34. It should be appreciated though, that although the modular barrel grenade launcher 80 is shown in combination with the previously described spring-loaded cock 34, the modular barrel grenade launcher 80 may be used in combination with any suitable triggering mechanism.

The modular barrel grenade launcher 80 may comprise a safety arrangement for locking the triggering mechanism so as to prevent the triggering mechanism from triggering the primer(s). Preferably, the safety arrangement is substantially similar to the safety arrangement with a rotatable rod 76 of FIGS. 15A-D.

The safety arrangement preferably comprises a handle 78 for actuating the safety arrangement. The handle 78 may be moveable between a first handle position and a second handle position. The first handle position may correspond to a position where the safety arrangement locks the triggering mechanism (i.e. where the safety arrangement prevents the triggering mechanism from triggering the primer 54). The second handle position may correspond to a position where the safety arrangement ensures that the triggering mechanism is in an unlocked state (i.e. where the safety arrangement allows the triggering mechanism to trigger the primer 54).

Preferably, the handle 78 is pivotably arranged such that a pivotal motion on the handle can move the handle 78 between the first and second handle positions. For example, the handle 78 may be pivotably arranged to allow a user to rotate the rod 76 (as previously described).

The handle 78 is preferably provided on the same side of the grenade launcher 80 as the inlet 90 to the barrel slot 88. The handle 78 may then be arranged such that the handle 78, in the second handle position shown in FIG. 18A (corresponding to an unlocked state of the triggering mechanism) at least partially blocks the inlet 90 to the barrel slot 88, while when the handle 78 is moved to the first handle position shown in FIG. 18B (corresponding to a locked state of the triggering mechanism), the handle 78 is moved away from the inlet 90 to the barrel slot 88. Thus, when the handle 78 is in the second handle position (i.e. the triggering mechanism being in an unlocked state) and at least partially blocking the inlet 90, the handle 78 prevents modular barrels 81 from being removed from and/or inserted into the barrel slot 88. Hence, modular barrels 81 can only be removed and/or inserted when the triggering mechanism is in a locked state, reducing the risk of accidents happening in assembling and/or manipulating the modular barrel grenade launcher 80.

The handle 78 of the safety arrangement thus performs two functions, the first function being transitioning the safety arrangement between a locked and unlocked state, and the second function being ensuring that modular barrels 81 can only be inserted when the safety arrangement is in a locked state.

Although the modular barrel grenade launcher 80 is shown in combination with the safety arrangement of FIGS. 15A-D, it will be appreciated that the modular barrel grenade launcher 80 may be used in combination with the safety arrangements of FIG. 7, the safety arrangement of FIGS. 8 to 14, or any other suitable safety arrangement.

Figure 19:
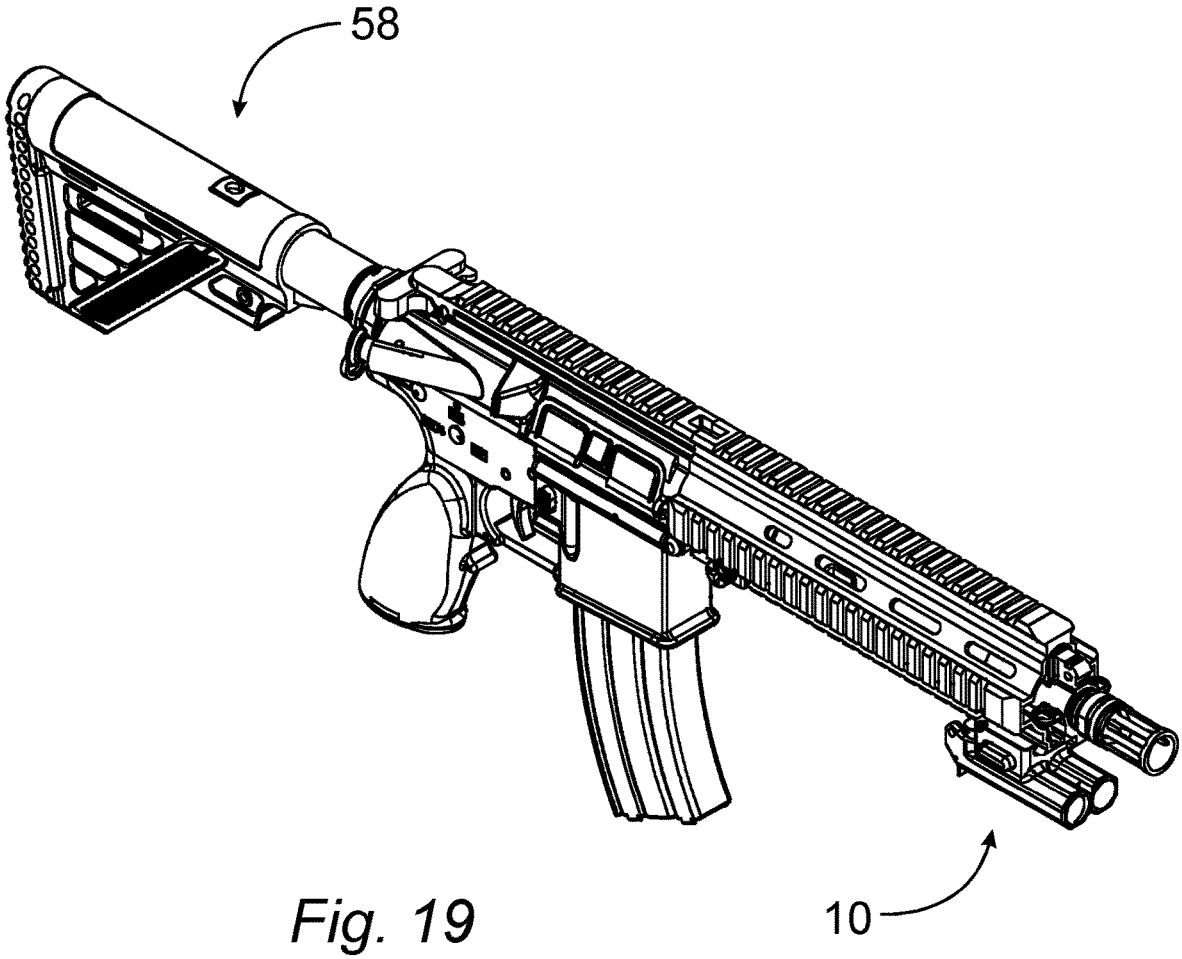
FIG. 19 is a schematic perspective view of the grenade launcher of FIG. 1 attached to a gun.

FIG. 19 shows a normal arrangement of the disclosed grenade launcher 10,80 attached to a guide rail at a front part of a gun 58.

In various embodiments, the grenade launcher 10, 80 comprises one barrel 12 only. In other embodiments, the grenade launcher 10, 80 comprises a plurality of barrels 12. One barrel can comprise a flashlight or be exchanged with a flashlight.

In alternative embodiments, the support 14 comprises a magnet, fastening straps, adhesive tape, or other fastening means. The support 12 can also be welded or attached by other means to the gun or to any other type of carrier.

The various embodiments described above are provided by way of illustration only and should not be construed to limit the invention. For example, the principles herein may be applied to any grenade launcher irrespective of how it is intended to be supported. Those skilled in the art will readily recognize various modifications and changes that may be made to the present invention without following the example embodiments and applications illustrated and described herein, and without departing from the scope of the present disclosure.

The invention claimed is:

1. A grenade launcher comprising:

a support for releasably mounting the grenade launcher to a carrier;

at least one cock that is spring biased to a lower grenade impacting position;

wherein the at least one cock is configured to be rotated manually to an upper armed position and manually released from the upper armed position to the lower grenade impacting position;

wherein the support is configured to be attached to a guide rail of a gun;

wherein the support includes a first fixed clamp portion and a second sliding clamp portion; and wherein the first fixed clamp portion and the second sliding clamp portion are configured to engage a dovetail section of the guide rail.

2. The grenade launcher of claim 1, wherein the second sliding clamp portion is spring biased to a locked position on the dovetail section of the guide rail.

3. The grenade launcher of claim 2, wherein the second sliding clamp portion is operatively connected to a knob extending from one side of the support.

4. The grenade launcher of claim 1, wherein the support comprises as boss configured to be received in a notch of the guide rail.

5. The grenade launcher of claim 1 comprising:

a safety arrangement configured to take a first position where the at least one cock is prevented from reaching the lower grenade impacting position, and alternatively a second position where the at least one cock is allowed to be manually released from the upper armed position to the lower grenade impacting position.

6. The grenade launcher according to claim 5, wherein the safety arrangement comprises:

a pin receiving aperture; and a locking pin;

wherein the locking pin is insertable into the pin receiving aperture;

wherein when the locking pin is inserted into the pin receiving aperture, the locking pin intersects with a path of the cock between the upper armed position and the lower grenade impacting position, such that the cock is prevented from reaching the lower grenade impacting position.

7. The grenade launcher according to claim 5, wherein the safety arrangement comprises a rotatably arranged rod;

wherein the rod is rotatable around a longitudinal axis of the rod between a first rotational position and a second rotational position;

wherein a distance between the longitudinal axis and an outer surface of the rod, in a direction perpendicular to the longitudinal axis and towards a path of the cock between the upper armed position and the lower grenade impacting position, is larger in the first rotational position than in the second rotational position, such that, in the first rotational position, the rod at least partially intersects with the path of the cock so as to prevent the cock from reaching the lower grenade impacting position, and in the second rotational position, the rod allows the cock to reach the lower grenade impacting position.

8. The grenade launcher according to claim 7, wherein the safety arrangement further comprises a pivotably arranged handle allowing a user to rotate the rod between the first and the second rotational positions.

9. The grenade launcher according to claim 7, wherein a cross section of the rod has a first width in a first direction, and a second width in a second direction, wherein the first width is greater than the second width.

10. A grenade launcher comprising:

a support for releasably mounting the grenade launcher to a carrier;

at least one cock that is spring biased to a lower grenade impacting position;

wherein the at least one cock is configured to be rotated manually to an upper armed position and manually released from the upper armed position to the lower grenade impacting position;

a safety arrangement configured to take a first position where the at least one cock is prevented from reaching the lower grenade impacting position, and alternatively a second position where the at least one cock is allowed to be manually released from the upper armed position to the lower grenade impacting position;

wherein the safety arrangement includes a sliding carriage mounted on the support; and wherein the sliding carriage is configured to be displaced between a rear position corresponding to the first position of the safety arrangement and a front position corresponding to the second position of the safety arrangement.

11. The grenade launcher of claim 10, wherein the support comprises an elongated groove configured to receive a slide of the sliding carriage.

12. The grenade launcher of claim 11, wherein the elongated groove is provided with at least one indentation configured to receive one locking peg connected to a spring biased release button;

wherein the locking peg will be displaced from the indentation by depressing the release button to allow the sliding carriage to slide to the front position and to set the safety arrangement to the second position.

13. A grenade launcher comprising:

a support for releasably mounting the grenade launcher to a carrier;

a barrel slot for receiving a plurality of barrels; and a respective plurality of triggering mechanisms;

wherein each triggering mechanism is configured to trigger a grenade inserted into the respective barrel;

wherein the barrel slot includes a slide rail configured to engage with engaging flanges of each barrel, such that the barrels are slidable into the barrel slot.

14. The grenade launcher according to claim 13, wherein the barrel slot comprises an inlet for receiving the barrels; and wherein the inlet is located on a first side of the grenade launcher.

15. The grenade launcher according to claim 13, wherein the grenade launcher further comprises a safety arrangement configured to, in a first position, prevent each triggering mechanism from being triggered, and alternatively in a second position allow each triggering mechanism to be triggered.

16. The grenade launcher according to claim 15, wherein the safety arrangement comprises a handle allowing a user to transition the safety arrangement between the first and the second positions;

wherein the handle is located on the first side of the grenade launcher;

wherein the handle is moveable between a first handle position corresponding to the safety arrangement being in the first position and a second handle position corresponding to the safety arrangement being in the second position;

wherein, in the first handle position, the inlet to the barrel slot is open, and in a second handle position, the handle at least partially blocks the inlet to the barrel slot.

17. The grenade launcher according to claim 13, wherein each triggering mechanism comprises a cock that is spring biased to a lower grenade impacting position;

wherein the cock is configured to be rotated manually to an upper armed position and manually released from the upper armed position to the lower grenade impacting position.

18. The grenade launcher according to claim 17, wherein the grenade launcher further comprises a safety arrangement that is configured, in a first position, to prevent each cock from reaching the lower grenade impacting position, and alternatively in a second position allow each cock to be manually released from the upper armed position to the lower grenade impacting position.

19. The grenade launcher according to claim 18, wherein the safety arrangement comprises a rotatably arranged rod;

wherein the rod is rotatable around a longitudinal axis of the rod between a first rotational position and a second rotational position;

wherein a distance between the longitudinal axis and an outer surface of the rod, in a direction perpendicular to the longitudinal axis and towards a path of the cock between the upper armed position and the lower grenade impacting position, is larger in the first rotational position than in the second rotational position, such that, in the first rotational position, the rod at least partially intersects with the path of the cock so as to prevent the cock from reaching the lower grenade impacting position, and in the second rotational position, the rod allows the cock to reach the lower grenade impacting position.

* * * * *